US009078074B2

(12) United States Patent
Sorensen et al.

(10) Patent No.: US 9,078,074 B2
(45) Date of Patent: Jul. 7, 2015

(54) METHOD AND APPARATUS FOR HEARING AID LOCATION

(71) Applicant: Starkey Laboratories, Inc., Eden Prairie, MN (US)

(72) Inventors: Bryant E. Sorensen, Austin, TX (US); Jeffrey Paul Solum, Greenwood, MN (US); Andrea Lea Pociecha, Apple Valley, MN (US); Krishna Sarbadhikari Rodemerk, Hopkins, MN (US); Jay Ashwin Shah, Eden Prairie, MN (US); John Edward Overland, Plymouth, MN (US); John Juri Jurisoo, Hopkins, MN (US); Charles William Reid, II, Shoreview, MN (US); Nasser Thomas Pooladian, Roseville, MN (US); Jorge F. Sanguino, Hopkins, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 5 days.

(21) Appl. No.: 13/725,747

(22) Filed: Dec. 21, 2012

(65) Prior Publication Data

US 2014/0177886 A1 Jun. 26, 2014

(51) Int. Cl.
*H04R 25/00* (2006.01)

(52) U.S. Cl.
CPC ..... *H04R 25/554* (2013.01); *H04R 25/55* (2013.01); *H04R 2225/51* (2013.01); *H04R 25/30* (2013.01)

(58) Field of Classification Search
CPC ..... H04R 25/558; H04R 25/30; H04R 25/55; H04R 2225/51; G08B 21/24; G08B 13/1427
USPC ..... 381/315
See application file for complete search history.

(56) References Cited

U.S. PATENT DOCUMENTS

| | | | | |
|---|---|---|---|---|
| 4,955,729 | A * | 9/1990 | Marx | 381/322 |
| 8,189,835 | B2 * | 5/2012 | Dietz | 381/315 |
| 8,363,868 | B2 * | 1/2013 | Fusakawa et al. | 381/315 |
| 8,442,435 | B2 * | 5/2013 | Jones et al. | 455/41.2 |
| 8,457,617 | B2 * | 6/2013 | Sweeney et al. | 455/418 |
| 8,532,715 | B2 | 9/2013 | Zheng et al. | |
| 2011/0294541 | A1 | 12/2011 | Zheng et al. | |
| 2012/0195449 | A1 * | 8/2012 | Thiede et al. | 381/315 |
| 2013/0178162 | A1 * | 7/2013 | Neumeyer et al. | 455/41.2 |
| 2013/0260784 | A1 * | 10/2013 | Lutz | 455/456.1 |

FOREIGN PATENT DOCUMENTS

WO WO-2011150101 A1 12/2011

* cited by examiner

*Primary Examiner* — Curtis Kuntz
*Assistant Examiner* — Ryan Robinson
(74) *Attorney, Agent, or Firm* — Schwegman Lundberg & Woessner, P.A.

(57) ABSTRACT

A hearing aid includes electronics, a physically manipulable member, and a receiver. The receiver is configured to output sound in a first mode at a first decibel level and in a second mode at a second decibel level higher than the first decibel level. The first mode is based on an input from a microphone. The second mode is based on the physically manipulable member not having been manipulated over a selected period of time. In various examples, wireless approaches are used to perform location identification. Examples using antennas and radio frequency identification (RFID) are provided. Various location approaches are possible using different location tones and methods for generation of such tones. Other apparatus are provided for location identification in a system with one or more hearing aids.

26 Claims, 6 Drawing Sheets

METHOD AND APPARATUS FOR HEARING AID LOCATION

TECHNICAL FIELD

This document relates generally to hearing aids and more particularly to location of hearing aids.

BACKGROUND

Hearing aids are often advantageously constructed to be as small as practical given the requirements of the hearing aid. Relatively smaller hearing aids can be less intrusive to a user and less visible to others. However, as with small objects generally, relatively small hearing aids can naturally be more difficult to locate than relatively larger hearing aids and may be more easily misplaced. Additionally, as many hearing aids can be utilized in settings in proximity of many other similar hearing aids, such as clinical settings, finding one particular hearing aid that has been misplaced may be made increasingly challenging as the size of hearing aids shrink.

SUMMARY

A hearing aid includes a microphone, a physically manipulable member, electronics, and a receiver according to one embodiment of the present subject matter. The hearing aid is configured to output sound in a first mode at a first decibel level and in a second mode at a second decibel level higher than the first decibel level. The first mode uses an input from a microphone. The second mode uses a detection of whether the physically manipulable member has not been manipulated over a selected period of time.

A hearing aid control device includes a control device antenna configured to receive a wireless signal transmitted from a hearing aid antenna. The control device is sensitive to a direction from which the wireless signal is received by the control device antenna. A user interface of the control device is configured to provide an indication of the direction from which the wireless signal was received.

A system includes a first hearing aid and a second hearing aid. The first hearing aid includes a first antenna and a transmitter configured to transmit a wireless signal using the first antenna. The second hearing aid includes a second antenna configured to receive the wireless signal and a receiver configured to output an audio signal indicative of a distance between the first antenna and the second antenna based on the wireless signal.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Various location modes can be applied to assist in locating a hearing aid. The location modes can incorporate existing hardware and/or software and/or firmware of the hearing aid or related articles in a hearing aid system. Such a system may include one or more hearing aids and a control device. In various applications, hearing aids can provide location information by instructions executed by one or more hearing aids and/or a control device to support one or more location modes. Certain location modes can be performed by programming of certain types of existing hearing aids. Alternatively, additional hardware and/or firmware and/or software elements can be incorporated into hearing aids to provide certain location modes.

Figure 1:
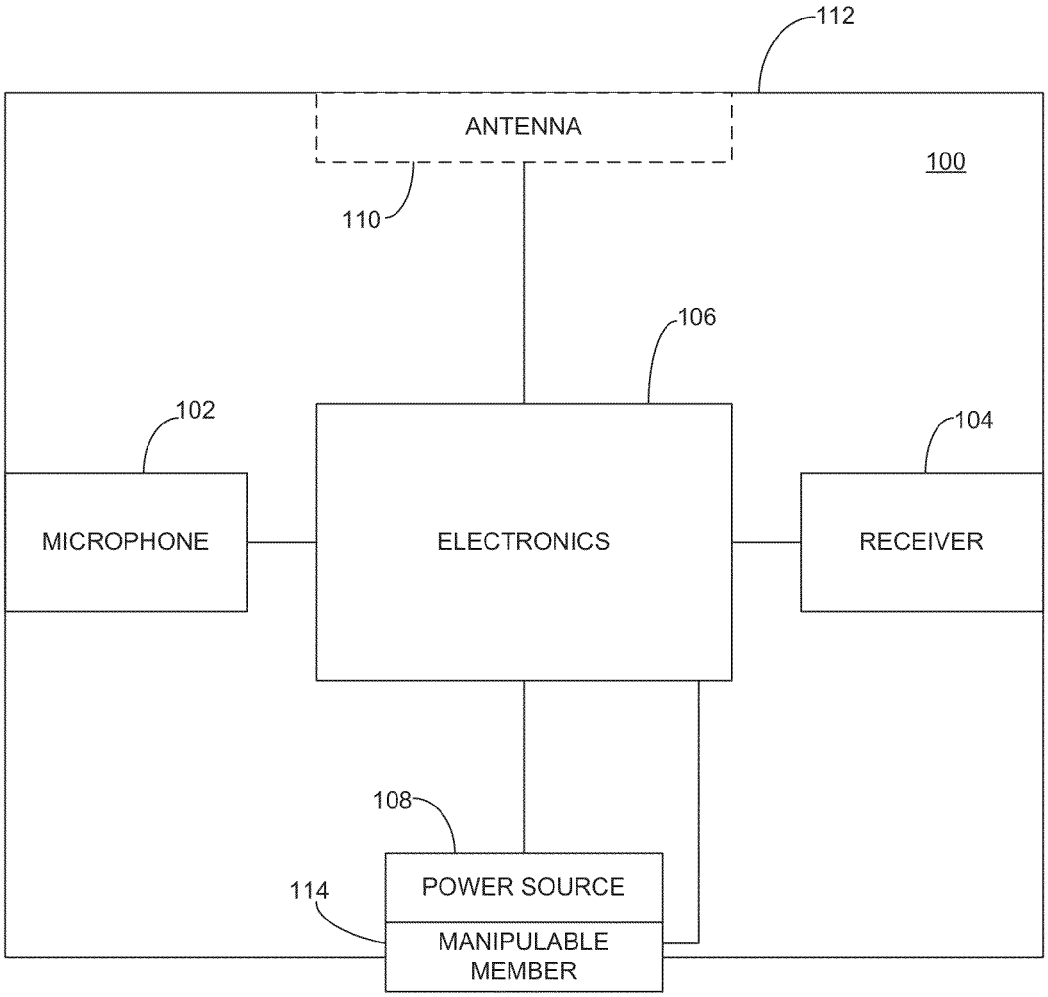
FIG. 1 is a block diagram of a hearing aid demonstrating one embodiment of the present subject matter.

FIG. 1 is a block diagram of a hearing aid 100 according to one embodiment of the present subject matter. The hearing aid 100 can be any of a variety of types and models of hearing aid known in the art, including, but not limited to, behind-the-ear (BTE), in-the-ear (ITE), in-the-canal (ITC), completely-in-the-canal (CIC) type hearing aids, or receiver-in-the-canal or receiver-in-the-ear (RIC or RITE) type hearing aids. The hearing aid 100 incorporates a microphone 102, a receiver 104, electronics 106, and a power source compartment 108. The microphone 102 is configured to sense environmental or ambient sounds. The receiver 104 is configured to output sound, including sound based on sound sensed by the microphone 102, at various decibel levels, including decibel levels comfortable for an ear of a patient.

The electronics 106 includes processing and control functionality for the hearing aid 100. In various embodiments, the electronics 106 further include circuitry for filtering, and amplifying an electronic signal related to sound sensed by the microphone 102. It is understood that other hearing aid processing, such as acoustic feedback cancellation, can be done without departing from the scope of present subject matter. An electronic signal related to the sound as modified by the electronics 106 is provided to the receiver 104. The electronics 106 can further be configured to perform control functionality relating to control of the hearing aid 100, including resource management, operating and updating hearing aid 100 firmware and hardware, and the like. In various embodiments, electronics 106 includes an optional transmitter and antenna 110 configured to produce a wireless signal.

The power source compartment 108 accommodates a variety of power sources to provide power to the electronics 106 and other components of the hearing aid 100 that utilize electrical power. In an example, the power source is a battery. The power source compartment 108 can be contained within a housing 112 of the hearing aid 100 and can be accessible for replacement of the power source via an optional physically manipulable member 114. The manipulable member 114 can be a door, an actuator, a switch, or other physically manipulable object that can at least actuate and/or secure or enclose, at least in part, the power source compartment 108. The hearing aid 100 can optionally include another physically manipulable member that is not associated with the power source, such as a switch or other force or pressure sensitive object. In such embodiments, the hearing aid 100 may or may not include a physically manipulable member 114 with respect to the power source. The member 114 can be associated with other aspects of the hearing aid, including, but not limited to, a user interface such as a button or switch. It can be incorporated into other hardware such as a pull handle or cable or other portion of a hearing aid. Therefore, the examples given herein are demonstrative and not intended in an exhaustive, exclusive or limiting sense.

In various embodiments, the manipulable member 114 is electrically coupled to the electronics 106. In various embodiments wireless approaches may be used. The electronics 106 are configured to receive an electronic notification when the manipulable member 114 is manipulated, such as when a door to access the power source compartment 108 is opened and/or closed, for instance during a procedure to replace the power source. Some hearing aids 100 are configured such that when the manipulable member 114 is not opened over a selected period of time to provide for replacing the power source, the electronics 106 drive the receiver 104 to output a tone to for locating the hearing aid 100.

In one example, the electronics 106 drive the receiver 104 to output a location tone that can be distinctly audible to a human at a distance from the hearing aid 100. The location tone may be selectable. The location tone may be selected based on the audiogram and resulting prescriptive gain of a user of the hearing aid 100. The receiver 104 can output sound at a first decibel level that is intended to be comfortable for a user of the hearing aid when the receiver 104 is positioned directly in an ear canal of the patient. However, in order to provide a location service for the hearing aid 100, the receiver 104 can output a location tone at a second decibel level that can, in various circumstances, be substantially higher than the first decibel level to aid in hearing the location tone multiple meters away from the hearing aid 100.

In various embodiments a plurality of ranges are used. To protect a potential user of the hearing aid 100, the location tone can ramp the location tone in amplitude, in patterned sound, in frequency, or in combinations thereof. In various embodiments, the location tone starts at a decibel level at about the decibel level at which the receiver 104 normally outputs environmental sound. In that way, a user who happens to have the receiver 104 positioned in their ear canal at the time of the first tone may not find the location tone uncomfortable.

The location tone can be a continuous tone or a periodic tone, such as a series of beeps or other distinct tones. The location tone can start at a relatively low level and ramp up to or beyond a second decibel level. The location tone can be stopped by a user physically manipulating the manipulable member 114. In the above example, the user can open and close the door to access the power source compartment 108. When the manipulable member 114 is manipulated the electronics 106 can stop outputting the location tone and reset monitoring an amount of time since the manipulable member 114 was last manipulated. In various embodiments other controls can be performed to stop the tone. For example, in various embodiments the hearing aid can be tapped to terminate the location mode. A hearing aid with motion detection capabilities can be shaken. Other sensing options are possible without departing from the scope of the present subject matter.

As noted above, the electronics 106 can initiate a location tone after a selected period of time. In one approach, the selected period of time is based upon an expected life of the power source. For instance, if the power source is expected to function for twenty-four (24) hours without replacement, then the selected period of time can be set at twenty-four (24) hours. In various embodiments, the interval is less than a day to accommodate location of a lost aid that has not been operated for a given amount of time. Other intervals and approaches may be used without departing from the scope of the present subject matter.

The electronics 106 can monitor manipulation of the manipulable member 114 and reset a clock with each manipulation. Consequently, to the extent that a user manipulates the manipulable member 114 within the selected period of time, the electronics 106 can reset the clock to the selected period of time. When the selected period of time is exhausted and the electronics 106 initiates the location tone, the location tone can be delivered continuously, such as with a constant tone, periodically, such as with beeps, or a combination of both continuous and periodic sounds, such as alternating between a continuous tone and beeps. The delivery of the location tone can continue until the manipulable member 114 is manipulated, as discussed above, or the power source is drained or substantially drained of power and the hearing aid 100 enters a non-functional or reduced functional mode. Other termination procedures can be implemented. For example, a second timer can play the location sound for a predetermined amount of time, and then rest for another amount of time. This allows the device to provide more location tones over an extended period of time so as to conserve battery energy if the device is not sought during the location tone period.

Figure 2:
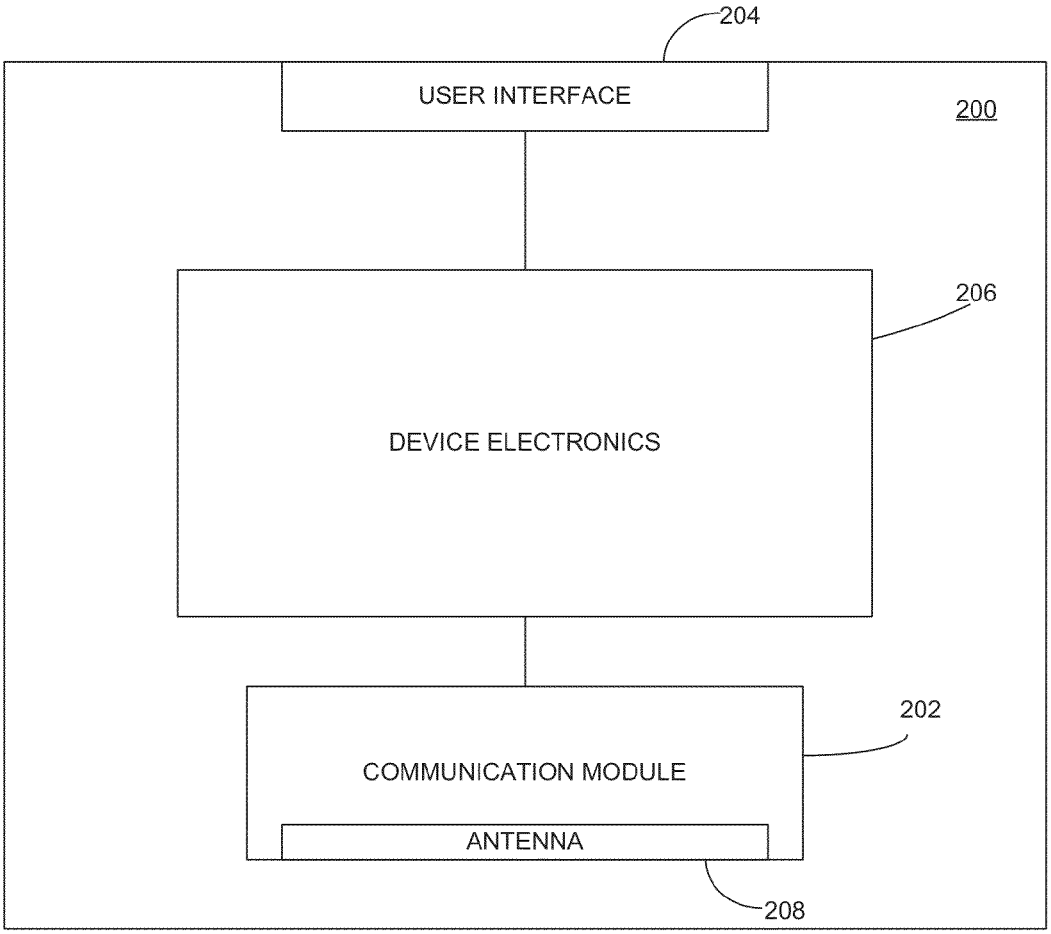
FIG. 2 is a block diagram of a hearing aid control device according to one embodiment of the present subject matter.

FIG. 2 is a block diagram of a hearing aid control device 200 configured to interact with and control, in various respects, the performance of a hearing aid, such as hearing aid 100. The control device 200 incorporates a communication module 202, a user interface 204, and device electronics 206. The communication module 202 optionally incorporates an antenna 208 configured to communicate wirelessly with the optional antenna 110 of the hearing aid 100. Alternatively or in addition to the antenna 208, the communication module 202 can communicate with the hearing aid 100 according to various wireless and wired communication modes.

The user interface 204 can incorporate a visual display for a user. The user interface 204 can further incorporate a receiver or other audio projection device for providing sound output to a user. The user interface 204 can further include additional user interface components known in the art, including buttons, touchscreens, and the like. As a whole, the user interface 204 can receive user inputs and provide user outputs. The device electronics 206 can provide the general functionality of the control device 200, and can include one or more processors, controllers, electronic memory, electronic storage, and the like. The device electronics 206 can control and receive output from the operation of, for instance, the communication module 202 and the user interface 204.

In an example, the antenna 208 receives a wireless signal transmitted from the antenna 110 of the hearing aid 100. In various embodiments, the control device 200 is "paired" or otherwise associated with the hearing aid 100. The hearing aid 100 can be configured to transmit a wireless signal, periodically or otherwise, to, for instance, establish or maintain a session with the control device 200 or to otherwise establish the presence of the hearing aid 100 in relation to the control device 200. To the extent that the control device 200 does not receive the wireless signal from the hearing aid 100 as expected, the control device 200 can deem the hearing aid 100 to be out of communication and/or physically out of range of wireless communication.

Upon having been deemed to be out of communication or range, the device electronics 206 can prompt the user interface 204 to provide an indication that the hearing aid 100 is out of range. The indication can be a visual indication, such as a message on a display or an illuminated light, or an audio indication, such as a tone or spoken message. The message on the display can state, for instance, "HEARING AID OUT OF RANGE" or a related or equivalent message. The receiver can provide a similar spoken message or a distinct tone.

The hearing aid 100 can continue to transmit the wireless signal when the control device 200 is not within range. Upon the antenna 208 sensing the wireless signal transmitted by the hearing aid 100, the user interface 204 can provide a visual or audible indication that the hearing aid 100 is in wireless communication range of the control device 200. Upon establishment of wireless communication, the user interface 204 can provide an indication that the hearing aid 100 is within wireless communication range.

The indication that the hearing aid 100 is within wireless communication range of the control device 200 can be presented or otherwise interpreted as an indication that the hearing aid 100 is at least as close to the control device 200 as the maximum wireless communication range between the hearing aid 100 and the control device 200. Consequently, a user who has misplaced their hearing aid 100 can utilize their control device 200 to search for the hearing aid 100. Upon receiving an indication via the user interface 204 that the hearing aid 100 is within a certain proximity of the control device 200, the user may localize a physical search for the hearing aid 100 to a known approximate wireless communication radius.

In an example, the control device 200 can provide the indication based, at least in part, on a signal strength of the wireless signal. A relatively stronger wireless signal can provide an indication that the hearing aid 100 is in relatively closer proximity of the control device 200 than when the wireless signal is relatively weaker. In an example, the device electronics 206 can be pre-programmed with relative signal strength values of the wireless signal. Based on cross-referencing the sensed signal strength from the antenna 208 with the relative strength values, a range from the antenna 208 to the antenna 110 can be estimated. The range can be based on a granular scale, such as integers from one to five, inclusive, with a "one" indicative of the hearing aid 100 being very close and a "five" being indicative of the hearing aid 100 being at extreme wireless communication range. The range can further or alternatively be based on correlated absolute distance, such as in feet or meters. Alternatively or in addition to signal strength, other aspects of the wireless signal, such as signal latency, can also be utilized to determine distance.

The user interface 204 can then provide an indication of range based on the value 206 determined by the device electronics 206. For instance, the user interface 204 can provide a visual indication of the range, such as by displaying an integer or graphic indicative of an integer or by displaying an absolute estimated distance, such as the range in feet or meters. Alternatively or additionally, the user interface 204 can provide an audio indication of the range, such as by providing a verbal indication of range or by providing beeps having a decibel level or frequency that vary as the range between the control device 200 and the hearing aid 100 decreases. For instance, the decibel level of the beeps can be relatively low when the range is long and high when the range is short, or the frequency of the beeps can start low when the range is long and become progressively higher when the range shortens. Consequently, a user can progressively narrow the scope of their search for the hearing aid 100 based on the indications of range provided by the control device 200.

The antenna 208 can optionally be a directional antenna. Consequently, the antenna can be sensitive both to absolute signal strength of the wireless signal as well as the direction from which the wireless signal is detected. An output of the antenna 208 to the device electronics 206 can thus be indicative not only of a signal strength of the wireless signal received by the antenna 208, but also of a direction from which the signal was received. It is noted that for various types of directional antenna known in the art, the perceived signal strength can depend on the direction in which the antenna 208 is pointed; that is to say, a directional antenna pointed directly at the antenna 110 may be sensitive to direction by detecting a stronger signal strength when pointing generally at the source of the wireless signal at a certain range than when pointing generally away from the source of the wireless signal at the same range.

Based on the output of the antenna 208 incorporating a directional antenna, the device electronics 206 can determine a direction from which the wireless signal originated. Such a direction can be inferred to be the location of the antenna 110 and hearing aid 100 generally. The user interface 204 can provide an indication of the direction, such as by physically displaying the direction of the source of the wireless signal, for instance with an arrow, or with a tone that changes based on whether the antenna 208 is pointing generally at the source of the wireless signal or generally away from the wireless signal. Consequently, by utilizing the control device 200, a user searching for a hearing aid 100 can be provided with an indication of proximity of the hearing aid 100, an indication of a direction of the hearing aid 100, or both.

In an example, the control device 200 can transmit a wireless signal back to the hearing aid 100. The wireless signal can incorporate information regarding the proximity and/or direction of the control device 200 to the hearing aid 100. The hearing aid can be configured to provide an audible indication of the proximity and/or direction of the hearing aid 100 to the control device 200 via the receiver 104. Consequently, in such a mode, the hearing aid 100 can be utilized to locate a misplaced control device 200 by, for instance, beeping at a frequency or decibel level relative to proximity, direction, or both.

Figure 3:
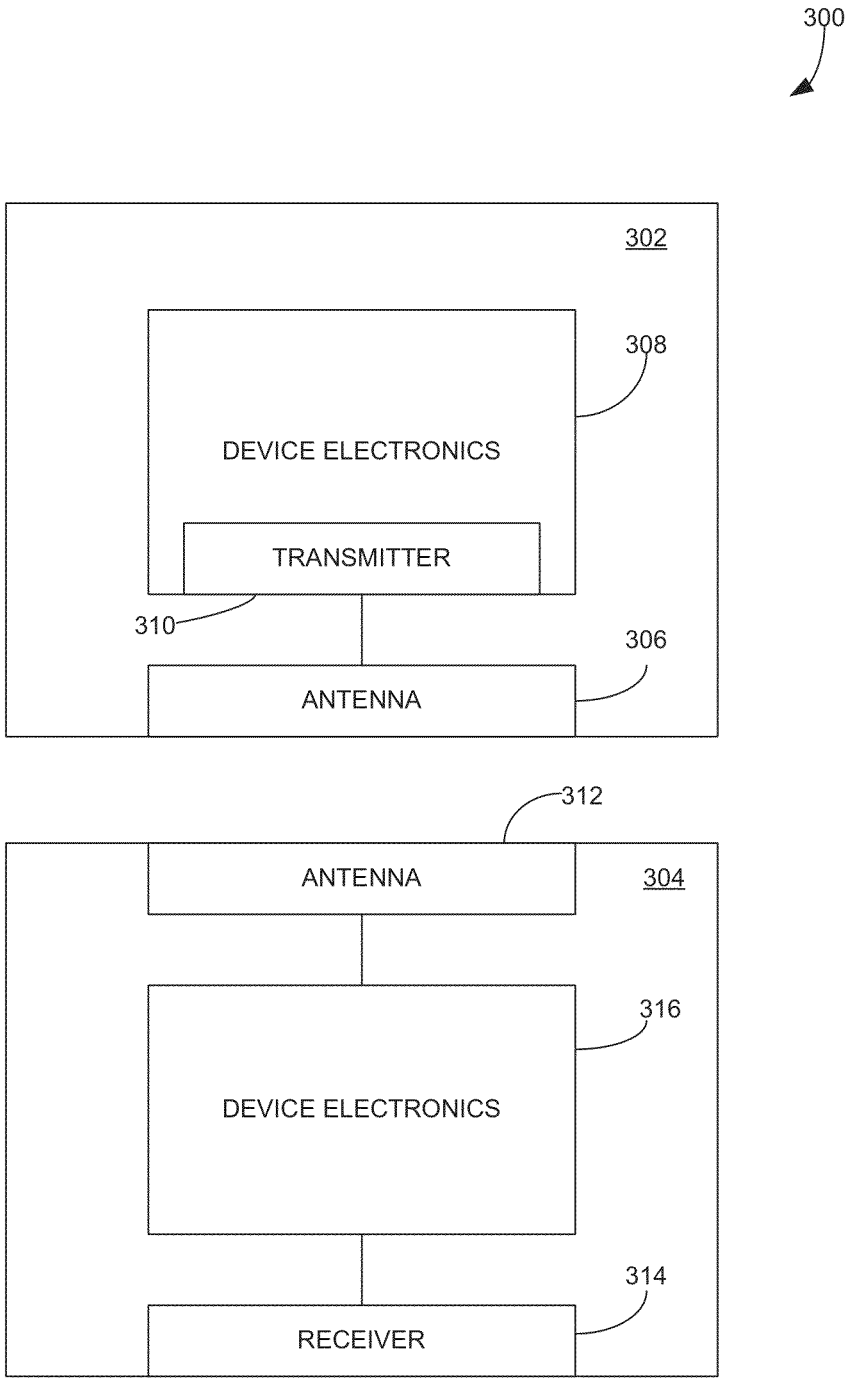
FIG. 3 is a block diagram of a system incorporating two hearing aids according to one embodiment of the present subject matter.

FIG. 3 is a block diagram of a system 300 incorporating two hearing aids 302, 304. In an example, hearing aids 302, 304 are a right and left pair of hearing aids, with the first hearing aid 302 configured to be used with respect to one ear of a patient and the second hearing aid 304 configured to be used with respect to the other ear of the patient. In various examples, one or both of the hearing aids 302, 304 is substantially similar to hearing aid 100. In various examples the hearing aids can incorporate various components not included in hearing aid 100. Thus, the array of possible hearing aids and hearing aid combinations is not limited to the hearing aid demonstrated by hearing aid 100.

As illustrated, the first hearing aid 302 incorporates a first antenna 306 and device electronics 308. The device electronics 308 can incorporate a transmitter 310 configured to transmit a wireless signal by way of the first antenna 306. The second hearing aid 304 incorporates a second antenna 312 and a receiver 314. The receiver 314 is electronically coupled to the second antenna 312 and is configured to output an audio signal. The audio signal can be based on a signal sensed by the second antenna 312 or by an environmental or ambient noise, such as can be detected by a microphone 102 that can be incorporated as a component of the second hearing aid 304.

The system 300 can provide an indication of location in a manner similar to that of the hearing aid 100 in relation to the control device 200. The first antenna 306 and the second antenna 312 can be configured to transmit and be sensitive to wireless signals of selected characteristics, such as power levels and frequencies. In an example, the first wireless signal can be initiated upon the user interacting with the first hearing aid 302, such as by manipulating a manipulable member 110 as with hearing aid 100. In an example, the transmitter 310 of the first hearing aid is configured to transmit a wireless signal by way of the first antenna 306. If the second antenna 312 does not sense the wireless signal, the receiver 314 can be prompted, such as by device electronics 316, to generate an audio signal indicative of the first hearing aid 302 being out of communication range of the second hearing aid 304. The audio signal can be suitable for hearing with the receiver 314 positioned in the ear canal of the user.

Upon the second antenna 312 receiving the wireless signal from the first antenna 306, the receiver 314 can be prompted to generate an audio signal indicative of the first antenna 306 being within wireless communication range of the second antenna 312. The audio signal can be based on a distance between the first antenna 306 and the second antenna 312. Distance can be inferred on the basis of signal strength of the sensed wireless signal. Alternatively or in addition, signal latency can also be utilized to infer distance. As in the above examples, relative changes in distance can prompt changes in the characteristics of the audio signal. For instance, the audio signal can include beeping that beeps relative slowly when the distance between the first antenna 306 and the second antenna 312 is relatively large and that beeps relatively quickly as the distance between the first antenna 306 and the second antenna 312 becomes relatively small.

In various applications, both the first and second antennas 306, 312 transmit and receive wireless signals, and both the first and second hearing aids 302 incorporate a receiver 314 that is configured to output an audio signal based on the distance between the antennas 306, 312. Thus, both of the hearing aids 302, 304 can generate audio signals indicative of distance, and whichever one or the other is in the ear of the user will provide the audio signal in aid of locating the missing hearing aid 302, 304.

In various examples, the receiver 314 is configured to provide the audio signal at a decibel level that varies depending on whether the hearing aid is in use. In such embodiments, a worn hearing aid can produce an audio signal at a relatively low decibel level while a hearing aid that is not worn can produce an audio signal at a relatively high decibel level.

In addition or in place of the transmission of a wireless signal via the antennas 306, 312, the hearing aids can incorporate radio frequency identification (RFID) tags within the device electronics 308, 316. The RFID tags can assist in location of the hearing aids 302, 304. As is known in the art, the RFID tags can transmit a unique identification via radio frequency communication. Receipt or lack of reception of the RFID tag can result in a similar response with the first and second hearing aids 302, 304 as discussed herein with respect to the wireless signals transmitted and received by the antennas 306, 312.

In a further example, the system can optionally incorporate the control device 200. In conjunction with the control device, the any two of the hearing aids 302, 304 and the control device 200 can be utilized to identify a location of a missing one of the hearing aids 302, 304 and the control device 200 using triangulation. Upon coming into signal range, the missing device 200, 302, 304 can transmit a wireless signal off of which the other two devices 200, 302, 304 can triangulate and localize a position. The indication of the location of the missing device 200, 302, 304 can be presented to the user in a manner consistent with the examples above.

Figure 4:
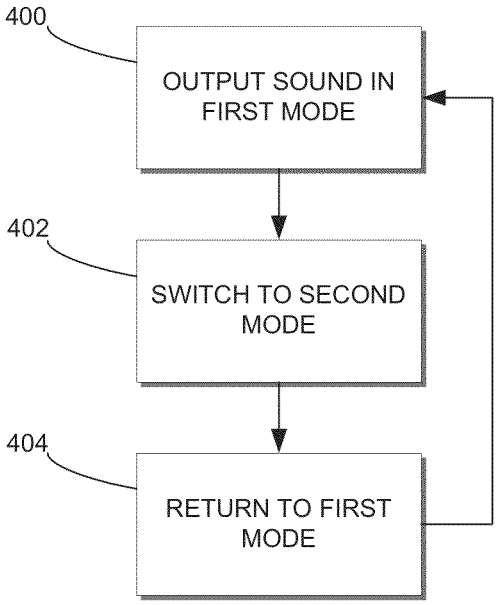
FIG. 4 is a flowchart for operating a hearing aid according to one embodiment of the present subject matter.

FIG. 4 is a flowchart for operating a hearing aid. While the flowchart will be discussed with respect to hearing aid 100, it is noted that the flowchart can be implemented with respect to any hearing aid or hearing assistance device generally that is suitably equipped.

At 400, sound is outputted in a first mode from the receiver 104 at a first decibel level. The sound is based on an input signal from the microphone 102. In various examples, the microphone 102 is sensitive to environmental or ambient noise. The output from the receiver 104 can be such ambient noise variably amplified, filtered, and modulated. The first decibel level can be suitable for projection into the ear canal of the user of the hearing aid 100.

At 402, the hearing aid 100 switches from the first mode to a second mode in which sound is outputted form the receiver 104. The sound in the second mode is at a second decibel level higher than the first decibel level. The second decibel level can be suitable for being heard at a distance from the hearing aid. The second decibel level be progressively increased until the hearing aid is instructed to terminate the sound. (e.g., when manipulable member 114 is manipulated). The hearing aid 100 switches from the first mode to the second mode based on the manipulable member 114 not having been manipulated for a selected period of time.

In an above example, the manipulable member 114 is a door for accessing the power source compartment 108. In such an example, the hearing aid 100 switches from the first mode to the second mode when the door has not been opened for the selected period of time.

At 404, the hearing aid 100 returns to outputting sound in the first mode from the receiver 104. The hearing aid 100 returns from the second mode to the first mode based upon the manipulable member 114 having been manipulated.

Figure 5:
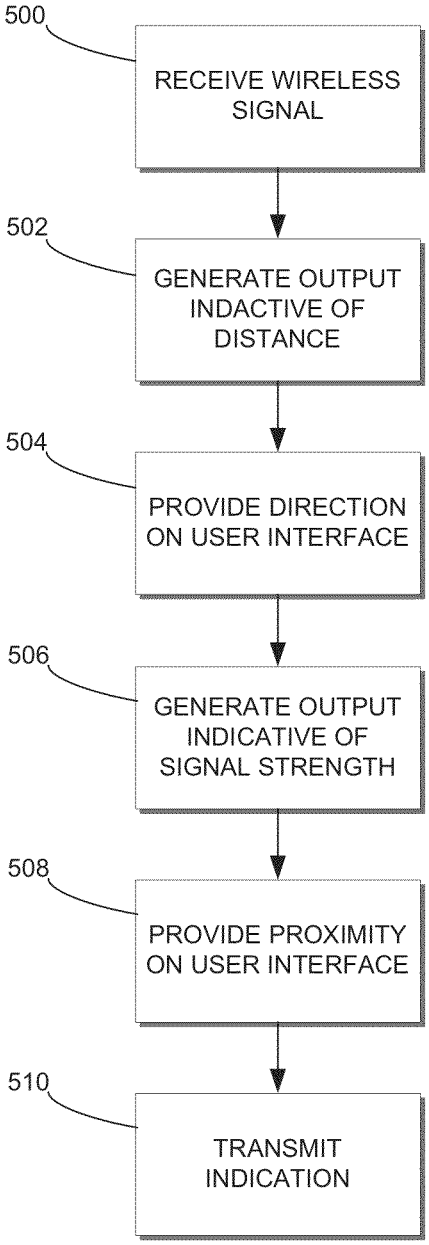
FIG. 5 is a flowchart for locating a hearing aid with a hearing aid control device according to one embodiment of the present subject matter.

FIG. 5 is a flowchart for locating a hearing aid with a hearing aid control device. While the flowchart will be discussed with respect to hearing aid 100 and control device 200, it is noted that the flowchart can be implemented with respect to any hearing aid, control device, or hearing assistance device generally that is suitably equipped.

At 500, a wireless signal is received with the then antenna 208. The wireless can have been transmitted from the antenna 110 of the hearing aid 100. The antenna 208 can be sensitive to the direction from which the wireless signal was received.

At 502, an output is generated by the antenna 208. The output can be indicative of the direction from which the wireless signal was received.

At 504, an indication of the direction from which the wireless signal was received can be provided by the user interface 204. In various examples, the indication is a visual indication, and audio indication, or both.

At 506, an output is generated by the antenna 280 that is indicative of a signal strength of the wireless signal. The output can occur serially or in parallel with the output generated at 502. In an example, the output at 506 is combined with the output at 502.

At 508, an indication of the proximity of the control device antenna 208 to the hearing aid antenna 110 is provided on the user interface 204 based on the output. The indication can be provided serially or in parallel with the indication of the direction at 504. In various examples, the indication is a visual indication, and audio indication, or both.

At 510, at least one of the indication of direction and proximity is transmitted to the hearing aid antenna 110 by the control device antenna 208. The hearing aid 100 can be configured to provide the at least one indication to the user.

Figure 6:
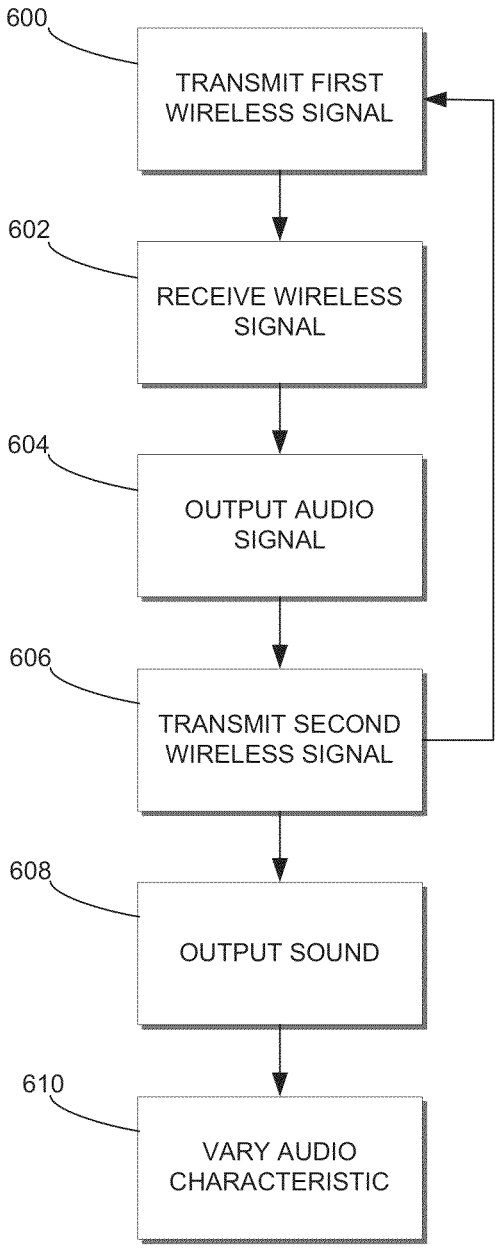
FIG. 6 is a flowchart for locating a hearing aid using another hearing aid according to one embodiment of the present subject matter.

FIG. 6 is a flowchart for locating a hearing aid using another hearing aid. While the flowchart will be discussed with respect to hearing aid 302, 304, it is noted that the flowchart can be implemented with respect to any hearing aid or hearing assistance device generally that is suitably equipped.

At 600, a first wireless signal is transmitted from the first antenna 306 of the first hearing aid 302. The transmission of the first wireless signal can be based on reception of a second wireless signal transmitted from the second hearing aid 304. The second wireless signal can At 602, the first wireless signal is received using the second antenna 312 of the second hearing aid 304.

At 604, an audio signal indicative of a distance between the first antenna 306 and the second antenna 312 is output by the receiver 314. The audio signal can be based, at least in part, on the receipt of the first wireless signal.

At 606, the second wireless signal is transmitted with the second antenna 312. Subsequent transmissions of the first wireless signal at 600 can be based on reception of the second wireless signal. The second wireless signal can incorporate any of a handshake procedure to establish a session between the first and second hearing aids 302, 304. The second wireless signal can be utilized to provide location information between the first and second antennas 306, 312.

At 608, the receiver 314 outputs sound based on an ambient or environmental noise.

At 610, the receiver 314 varies an audio characteristic of the audio signal based on the wireless signal. The audio characteristic can be varied based on the signal strength. The audio characteristic can be one of a decibel level of the audio signal and a frequency of the audio signal.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid, comprising:

a microphone;

electronics in communication with the microphone;

a receiver in communication with the electronics and configured to selectively output sound; and a physically manipulable member in communication with the electronics;

wherein the hearing aid is configured to:

output sound in a first mode at a first decibel level based on an input from the microphone;

output sound in a second mode at a second decibel level based on the physically manipulable member not having been manipulated over a selected period of time, the second decibel level being higher than the first decibel level; and wherein the second decibel level is selected to aid in determining a physical location of the hearing aid; and a housing, wherein the physically manipulable member is a door in the housing that provides access to a compartment configured to seat a battery.

2. The hearing aid of claim 1, wherein the door is manipulated upon being been opened and wherein opening the door generates an electrical signal to the electronics upon which the selected period of time is based.

3. The hearing aid of claim 2, wherein the selected period of time is approximately twenty-four hours.

4. The hearing aid of claim 1:

wherein the first mode corresponds to an amplification of ambient noise, detected by the microphone, at the first decibel level corresponding to a level suitable for projection essentially directly into an ear canal of a user of the hearing aid; and wherein the second mode corresponds to a tone at the second decibel level corresponding to a level suitable for projection into an ambient environment outside of the ear canal to locate the hearing aid.

5. The hearing aid of claim 4, wherein the second decibel level progressively increases until the physically manipulable member is physically manipulated.

6. A method of operating a hearing aid having a microphone, electronics, a receiver, and a physically manipulable member, wherein the hearing aid has a housing, wherein the physically manipulable member is a door in the housing that provides access to a compartment configured to seat a battery, the method comprising:

outputting sound in a first mode from the receiver at a first decibel level based on an input from the microphone;

switching from the first mode to outputting sound in a second mode from the receiver at a second decibel level based on the physically manipulable member not having been manipulated over a selected period of time, the second decibel level being higher than the first decibel level;

wherein manipulating the physically manipulable member comprises opening the door to physically manipulate the door and transmit an electrical signal to the receiver; and returning to outputting sound in the first mode upon the physically manipulable member being manipulated.

7. The method of claim 6, wherein the selected period of time is approximately twenty-four hours.

8. The method of claim 6:

wherein the first mode corresponds to an amplification of ambient noise, detected by the microphone, at the first decibel level corresponding to a level suitable for projection essentially directly into an ear canal of a user of the hearing aid; and wherein the second mode corresponds to a tone at the second decibel level corresponding to a level suitable for projection into an ambient environment outside of the ear canal to locate the hearing aid.

9. The method of claim 6, wherein the second decibel level progressively increases until the physically manipulable member is physically manipulated.

10. A hearing aid control device, comprising:

a control device antenna configured to receive a wireless signal transmitted from a hearing aid antenna of a hearing aid;

wherein the control device antenna is sensitive to a direction from which the wireless signal is received by the control device antenna; and wherein the control device antenna is configured to generate an output indicative, at least in part, of a direction from which the wireless signal is received; and wherein the control device antenna is configured to transmit at least one of the indication of the direction and the indication of the proximity to the hearing aid antenna, wherein the hearing aid is configured to provide to the user a sound based on the at least one of the indication of the direction and the indication of the proximity, the at least one of the indication of the direction and the indication of the proximity being indicative of a direction and a proximity to the hearing aid control device, respectively.

11. The hearing aid control device of claim 10, wherein the control device antenna is further configured to generate the output further indicative, at least in part, of a signal strength of the wireless signal, and wherein the hearing aid is further configured to provide to the user the sound based on the indication of a proximity of the control device antenna to the hearing aid antenna based, at least in part, on the output.

12. The hearing aid control device of claim 11, wherein the hearing aid comprises a receiver configured to provide at least one of the indication of the direction and the indication of the proximity.

13. The hearing aid control device of claim 11, further comprising a controller configured to generate the indication of the direction and the indication of the proximity based, at least in part, on the output of the control device antenna.

14. A method, comprising:

receiving, with a control device antenna of a hearing aid control device, a wireless signal transmitted from a hearing aid antenna of a hearing aid, wherein the control device antenna is sensitive to a direction from which the wireless signal is received by the control device antenna;

generating, with the control device antenna, an output indicative, at least in part, of a direction from which the wireless signal was received; and transmitting, using the control device antenna, at least one of the indication of the direction and the indication of the proximity to the hearing aid antenna, wherein the hearing aid is configured to provide to the user a sound based on the at least one of the indication of the direction and the indication of the proximity, the at least one of the indication of the direction and the indication of the proximity being indicative of a direction and a proximity to the hearing aid control device, respectively.

15. The method of claim 14, further comprising:

generating, with the control device antenna, the output further indicative, at least in part, of a signal strength of the wireless signal; and providing, with the hearing aid, the sound based on the indication of a proximity of the control device antenna to the hearing aid antenna based, at least in part, on the output.

16. The method of claim 15, wherein the hearing aid comprises a receiver configured to provide at least one of the indication of the direction and the indication of the proximity.

17. The method of claim 15, further comprising generating, with a controller of the hearing aid control device, the indication of the direction and the indication of the proximity based, at least in part, on the output of the control device antenna.

18. A system, comprising:

a first hearing aid configured to be positioned, at least in part, in a first ear of a user, comprising:

a first antenna; and a transmitter configured to transmit a wireless signal using the first antenna; and a second hearing aid configured to be positioned, at least in part, in a second ear of the patient, comprising:

a second antenna configured to receive the wireless signal; and a receiver, coupled to the second antenna, configured to output an audio signal indicative of a distance between the first antenna and the second antenna based on the wireless signal, the audio signal having an audio characteristic that is variable based on the distance;

wherein the wireless signal is a first wireless signal, wherein the second hearing aid is configured to transmit a second wireless signal via the second antenna, and wherein the transmitter is configured to transmit the first wireless signal based on reception of the second wireless signal.

19. The system of claim 18, wherein the receiver is configured to output the audio signal based on receipt of the wireless signal by the second antenna.

20. The system of claim 19, wherein the audio characteristic is at least one of a decibel level of the audio signal and a frequency of the audio signal.

21. The system of claim 18, wherein the receiver is configured to vary the audio characteristic of the audio signal based on a signal strength of the wireless signal.

22. The system of claim 18, wherein the receiver is further configured to output sound based on an ambient noise.

23. A method, comprising:

transmitting, from a first antenna of a first hearing aid, a first wireless signal;

receiving, using a second antenna of a second hearing aid, the first wireless signal;

outputting, using a receiver of the second hearing aid, an audio signal indicative of a distance between the first antenna and the second antenna based on the first wireless signal as received by the second antenna;

varying an audio characteristic of the audio signal based on the first wireless signal; and transmitting, with the second antenna, a second wireless signal;

wherein transmitting the first wireless signal is based on reception of the second wireless signal.

24. The method of claim 23, wherein varying the audio characteristic of the audio signal is based on a signal strength of the first wireless signal.

25. The method of claim 23, further comprising outputting, using the receiver, sound based on an ambient noise.

26. The method of claim 23, wherein the audio characteristic is at least one of a decibel level of the audio signal and a frequency of the audio signal.

* * * * *